US006024153A

United States Patent [19]

Goldman

[11] Patent Number: 6,024,153

[45] Date of Patent: Feb. 15, 2000

[54] RETRACTABLE SUKKAH AWNING

[76] Inventor: Tzvi Goldman, 708 Park Ave., Lakewood, N.J. 08701

[21] Appl. No.: 08/909,467

[22] Filed: Aug. 11, 1997

[51] Int. Cl.[7] ..... E04F 10/08

[52] U.S. Cl. ..... 160/61; 160/84.01; 160/84.06; 160/60; 160/370.23; 47/26

[58] Field of Search ..... 160/58.1, 60, 64, 160/84.01, 84.04, 84.06, 84.07, 128, 370.23, 382, 388; 47/17, 26

[56] References Cited

U.S. PATENT DOCUMENTS

| | | | |
|---|---|---|---|
| 405,475 | 6/1889 | Hohorst | 160/84.01 X |
| 652,263 | 6/1900 | Hansen | 160/58.1 |
| 3,140,563 | 7/1964 | Allen | 47/26 X |
| 3,348,705 | 10/1967 | Yanow | 160/84.06 X |
| 3,964,781 | 6/1976 | Fenton | 160/84.06 X |
| 3,986,749 | 10/1976 | Hull et al. | 160/84.06 X |
| 4,375,232 | 3/1983 | Heescher et al. | 160/84.06 |
| 4,676,039 | 6/1987 | Leiter et al. | 52/282 |
| 4,677,797 | 7/1987 | Roth | 52/94 |
| 4,944,552 | 7/1990 | Hardy, Jr. | 160/84.06 X |
| 5,253,914 | 10/1993 | Biancale | 160/84.06 X |
| 5,265,373 | 11/1993 | Vollebregt | 160/84.01 X |
| 5,645,119 | 7/1997 | Caruso | 160/370.23 |

*Primary Examiner*—Daniel P. Stodola
*Assistant Examiner*—Bruce A. Lev
*Attorney, Agent, or Firm*—Arthur M. Peslak

[57] ABSTRACT

A retractable awning and support structure to be installed as a cover for a ceremonial Jewish structure known as a Sukkah. The awning is fabricated from a rigid plastic material and formed in an accordion like structure. The awning is connected to a support structure that is attached to the Sukkah.

3 Claims, 5 Drawing Sheets

RETRACTABLE SUKKAH AWNING

The present invention relates to a retractable awning device that can be fitted to ceremonial Jewish Sukkahs or other temporary shelters providing both open air access through the roof and protection from rain. The present invention provides the Sukkah with planned water drainage, convenient operation from the interior of the Sukkah, elimination of standing water on the closed awning, protection from the elements and flexibility of design permitting adaptation of the invention to a wide variety of Sukkah configurations with minimal effort or cost.

BACKGROUND OF INVENTION

A Sukkah is a ceremonial Jewish structure that is erected outdoors to shelter people during certain religious holidays. The prior structures used as Sukkahs have suffered from problems when rain falls during the time people are inside the structure.

The prior Sukkah structures have generally been covered with retractable flat canvas covers. The problem with those structures is that when the rainfall is heavy the structure will sag in the middle from the weight of the water. In addition, these canvas covers can become saturated with water and begin to leak through the material into the interior of the structure. If enough rain is present on top of those covers, the water may begin falling over the edges into the structure itself with the occupants of the structure getting wet. When the canvas cover is closed, ventilation will be poor. In addition, the roof cover generally can be retracted only leaving the interior of Sukkah the structure itself. When the roof cover is retracted after the rain, the water on top of the cover generally falls at least partly inside the structure again getting the occupants wet.

SUMMARY OF THE INVENTION

The present invention is directed to solving the aforementioned problems with Sukkah covers. Thus, the present invention comprises a retractable awning that provides rainwater protection for Sukkahs. A unique combination of features and functions differentiate the present invention from other temporary roofing structures available for Sukkahs. The first feature of the present invention is that the awning is fully retractable, opening the entire top of the Sukkah structure to the sky. Secondly, in the closed position, the awning diverts and drains rainwater to a planned side of the Sukkah, providing a dry interior and the ability to plan the drainage of the awning runoff. The awning is also designed in such a manner to prevent water from standing on top of the awning, eliminating the possibility of water permeating the awning material or entering the Sukkah when the awning is retracted. The awning of the present invention will provide for better ventilation than prior canvas covers when the awning is closed. Additionally, the present invention is flexible in design as to be able to be adapted to existing structures with little modification and can be readily fabricated to cover a wide range of Sukkah sizes and configurations with little cost or additional engineering effort.

The function of the present invention is accomplished through the use of an aluminum support frame which is mounted to the Sukkah, providing support from which the retractable awning can be traveled over and protect the Sukkah. An added convenience of the present invention is that the awning may be opened and closed from inside the Sukkah.

DETAILED DESCRIPTION OF THE INVENTION

Figure 1:
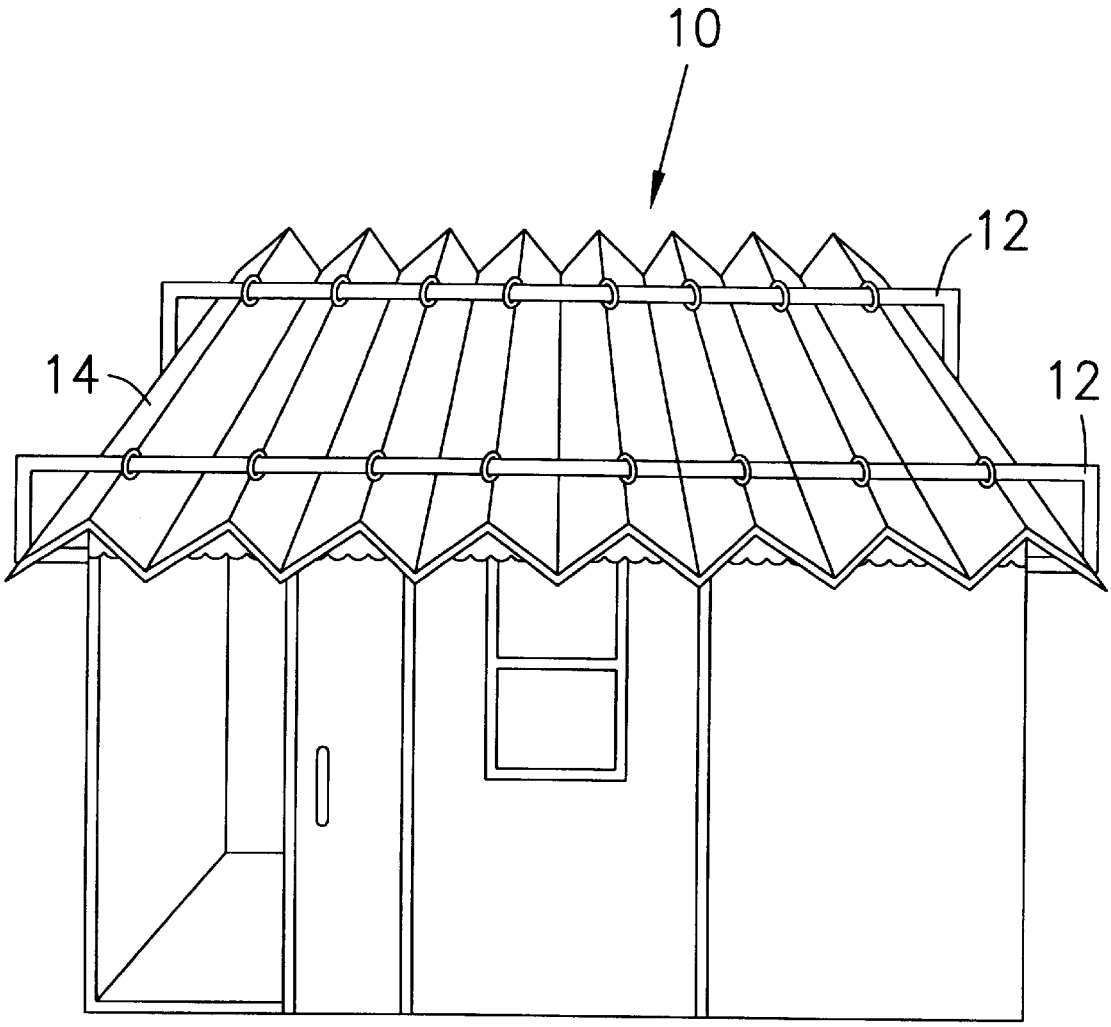
FIG. 1 is a front plan view of the present invention installed on a Sukkah structure.

The present invention is directed to a retractable Sukkah awning assembly 10. The awning assembly 10 comprises a support structure 12. An awning 14 is suspended from the support structure 12 as shown in FIG. 1.

Figure 7:
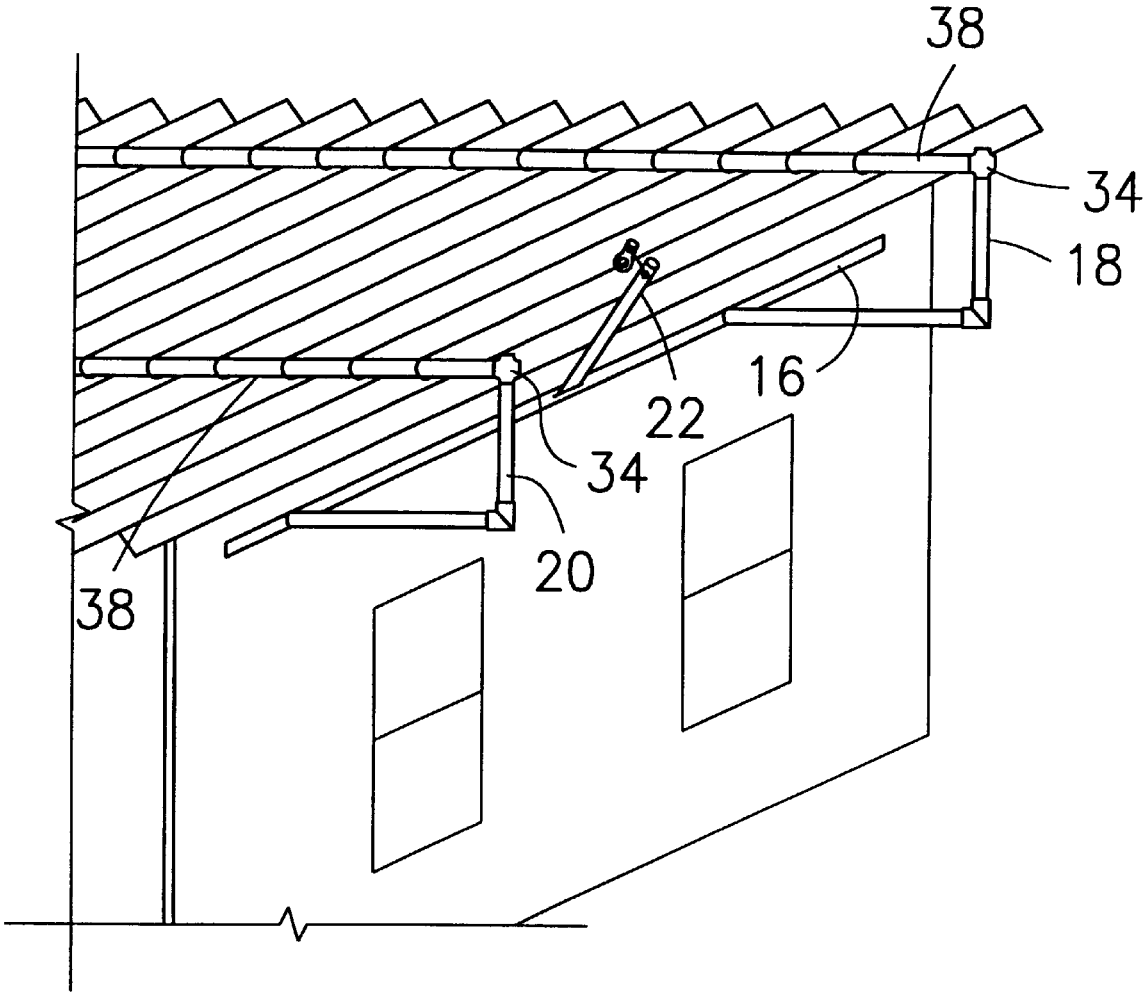
FIG. 7 is a partial plan view of the present invention installed on a Sukkah structure.

One side of the Sukkah is illustrated in FIG. 7 but is illustrative of both sides of the structure. The support structure 12 is comprised of an aluminum pipe fabrication comprising a primary support pipe 16, a long arm assembly 18, a short arm assembly 20, and a center pipe 22. The embodiment illustrated in the figures is illustrative and may be varied by those of ordinary skill in the art by utilizing other materials, shapes, or profiles without departing from the spirit or scope of the present invention.

Figure 3A:
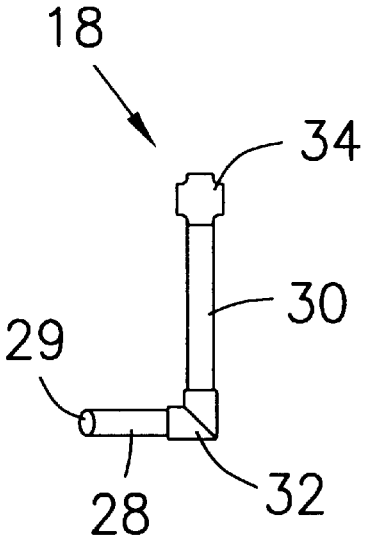
FIGS. 3*a* and 3*b* are front plan views of two components of the support structure of the present invention.
Figure 3B:
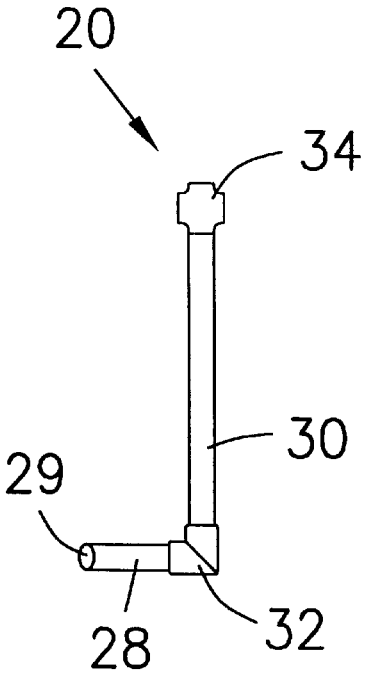

FIGS. 3*a* and 3*b* illustrate in more detail the short arm assembly 18 and the long arm assembly 20. The arm assemblies 18 and 20 each comprise a horizontal section 28 and a vertical section 30. The horizontal section 28 comprises a free end 29 and is connected to a 90° elbow 32 at the other end. The vertical section 30 is connected to the elbow 32 on one end and to a fitting 34 at the other end. The fitting 24 is orientated to accept center support pipes 38. As shown in FIG. 7, center support pipes 38 will be oriented parallel to the horizontal sections 28. In the embodiment shown in the figures, the length of vertical section 30 in short arm assembly 18 is shorter than the length of vertical section 30 in long arm assembly 20.

Figure 4:
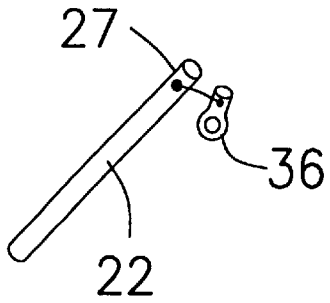
FIG. 4 is a front plan view of a component of the support structure of the present invention.

As illustrated in FIG. 4, the center pipe 22 is a straight length of pipe. A pulley 36 is attached thereto at end 23.

Figure 2:
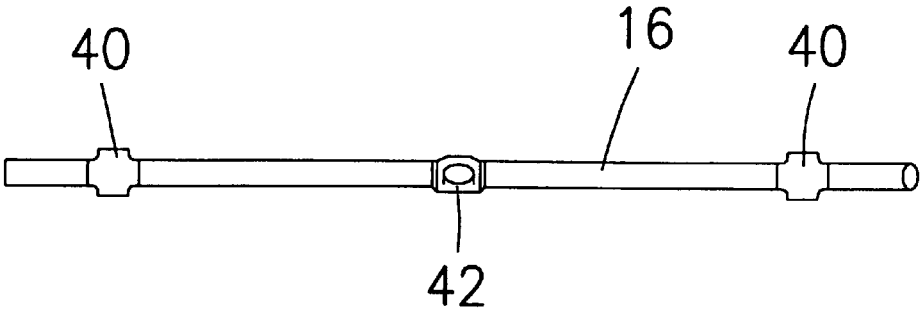
FIG. 2 is a front plan view of a component of the support structure of the present invention.

As shown in FIG. 2, the primary support pipes 16 each comprise a plurality of straight sections of pipe joined by fittings 40 and 42. The fittings 40 are oriented to each receive a pipe at the same angle. The center fitting 42 is oriented to receive a pipe oriented at approximately 45° from the pipes received in fittings 40.

As illustrated in FIG. 7, the primary support pipe 16 is rigidly attached to a side wall of the Sukkah structure at or near the top of the wall in a manner well known to those of ordinary skill in the art such as screws or other similar fastening devices. The primary support pipe 16 is oriented to the wall of the Sukkah such that the two fittings 40 may receive a pipe oriented approximately perpendicular to the wall of the Sukkah. The center fitting 42 is oriented to receive a pipe at 45° with respect to the wall. The free end 29 of the support arms 28 are installed into the two fittings 40. The short arm assemblies 18 will be located on the side of the Sukkah structure onto which the drainage for the rainwater will be directed. The center fitting 42 accepts the center pipe 22.

Figure 5:
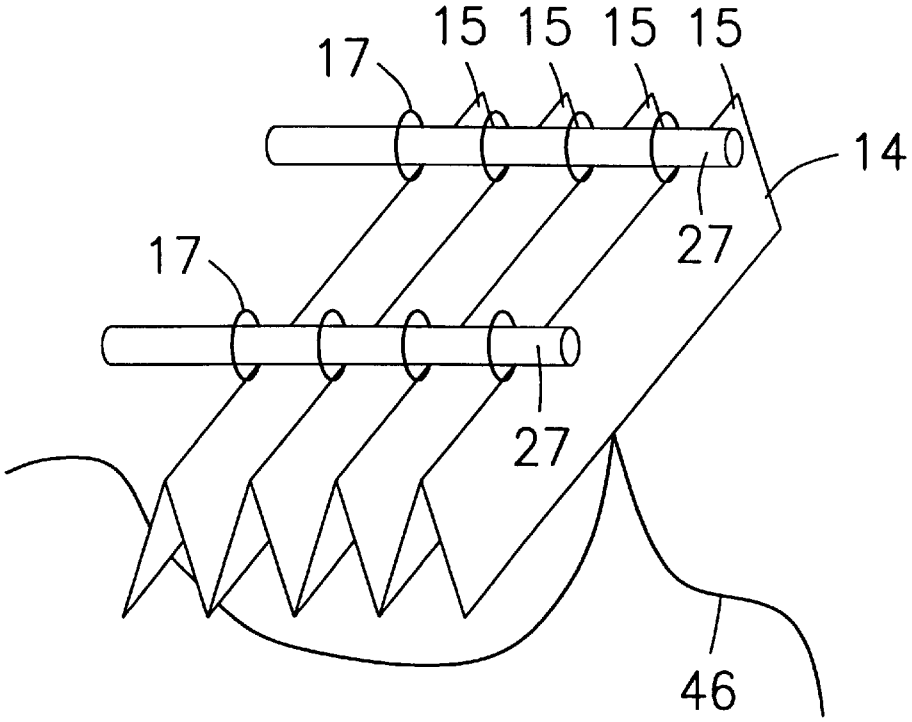
FIG. 5 is a top plan view of the awning assembly of the present invention.

A detail of the awning 14 is illustrated in FIG. 5. The awning 14 is composed a lightweight rigid corrugated plastic sheet or similar material. The awning 14 is pleated at a plurality of points 15 to create an accordion-like configuration. At the points 15 of each pleat, two rows of rings 17 are attached to the awning. The center support pipes 38 are placed through the row of rings 17. In this manner, the awning 14 is suspended from the center support pipes 38. The rings 17 are free to travel along the center support pipes 38 allowing the awning to be folded tightly together, or expanded to cover the entire length of center support pipe 38.

Figure 6:
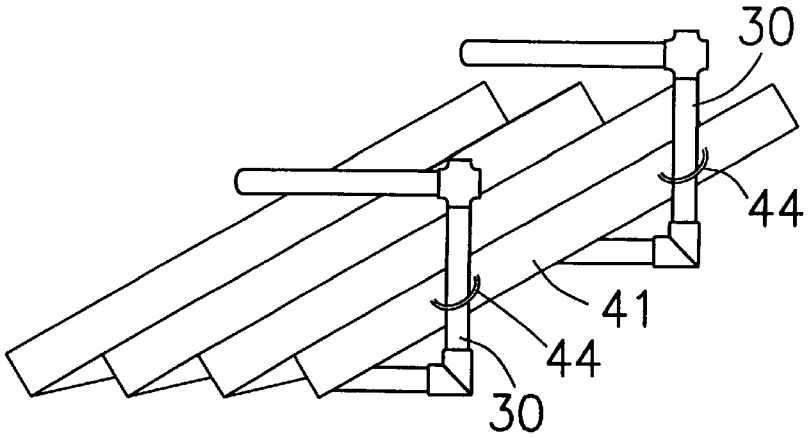
FIG. 6 is a top plan view of the awning assembly of the present invention.
Figure 8:
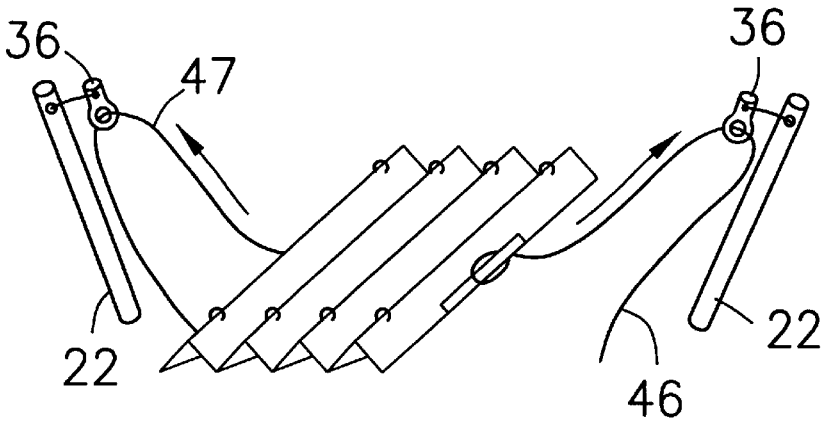
FIG. 8 is a plan view of the awning assembly of the present invention.

The awning 14 and center support pipes 38 are positioned over the Sukkah as shown in FIG. 7. The center support pipes 38 are attached to the fittings 34. One end 41 of the awning 14 is fixed to the support arms 30 by means of rings 44 as shown in FIG. 6. Thus, the end 41 of awning 14 is stationary. The opposite end of awning 14 is allowed to move relative to the stationary end 41. Control line 46 is fixed to the moving end of awning 14 as illustrated in FIG. 8. The control line 46 is threaded through the pulley 36 attached to the center pipe 22. A lubricant may also be placed on the pulley 36 so that the control line 46 will move easily over the pulley 36. The control line 46 is threaded through the pulleys 36 so that the running end of the control line 46 is run through the pulleys 36 towards the opposite end of the pipes 38. The control line 47 which is run to the center pipe 22 on the opposite end of the awning 14 is run under the awning 14. By doing this, the awning 14 may be drawn open or folded tight together by pulling the appropriate control line 46 or 47.

When the awning 14 is drawn closed as illustrated in FIG. 7, the Sukkah interior will be covered and protected from rainfall. The rain will be trapped in the bottom of sections of the awning 14 between the pleat points 15. As noted above, the support structure is provided with a short arm section 18 and a long arm section 20. Because the vertical height of the pipes 30 is slightly different, the awning 14 is installed at a slight angle to the horizontal. Thus, when rain is collecting in the awning 14, it will naturally run out of the sections between the pleat points 15 outside the Sukkah structure. Consequently, water will not gather on top of the roof but will run continuously outside the Sukkah structure.

In operation, the ends of the control line 46 and control line 47 will be lead into the interior of the Sukkah structure. Consequently, a person will be able to expand or retract the awning without leaving the interior of the Sukkah. It may also be necessary in practice to prevent the first several slats on the awning 14 from stretching too far when the awning is opened.

Those of ordinary skill in the art will recognize that the embodiment just described merely illustrates the principles of the present invention. Many modifications may be made thereto without departing from the spirit and scope of the invention as set forth in the following claims.

What is claimed is:

1. A combination retractable and expandable roof covering assembly and sukkah structure wherein the sukkah structure comprises four vertical walls aligned to form an interior of the sukkah structure and an open top area that is located in a horizontal plane comprising:

a) a retractable and expandable awning fabricated from a rigid material and comprising a plurality of pleated points;

b) a support structure for the roof covering assembly rigidly attached to the outside of two outside opposing vertical walls of the sukkah structure comprising a plurality of pipes and fittings such that the awning is supported from said plurality of the pipes positioned above the awning;

c) means for slidingly attaching the awning to the support structure at the plurality of pleated points such that the awning is set at a predetermined angle with respect to a horizontal plane of the open top area of the sukkah structure to allow rain water to naturally run off the awning; and d) means for expanding and retracting the awning over the top of the sukkah structure.

2. The combination of claim 1 wherein the means for slidingly attaching the awning to the pipes at the plurality of pleated points is a plurality of rings fixed to the top of the plurality of pleated points and through which support pipes for the awning are received.

3. The combination of claim 2 wherein the means for expanding and retracting the awning over the open top area of the sukkah structure comprises a plurality of pulleys mounted to the outside of the vertical walls of the sukkah structure and a plurality of control lines connected on one end to the plurality of pulleys, to each end of the awning, and with the other end of the control line being located in the interior of the sukkah structure such that the awning can be expanded or retracted from inside of the sukkah structure.

* * * * *